US005743118A

United States Patent [19]

Anderson

[11] Patent Number: 5,743,118

[45] Date of Patent: Apr. 28, 1998

[54] LOCK GUARD FOR A TRACTOR TRAILER

[76] Inventor: Kenneth E. Anderson, Rt. 2 Box 2674, Soldiers Grove, Wis. 54655

[21] Appl. No.: 790,352

[22] Filed: Jan. 24, 1997

[51] Int. Cl.[6] ..... E05B 67/38

[52] U.S. Cl. ..... 70/56; 70/203; 70/417; 292/205

[58] Field of Search ..... 70/54, 55, 56, 70/201–203, 417, 158, 163, 164; 292/148, 205

[56] References Cited

U.S. PATENT DOCUMENTS

| | | | |
|---|---|---|---|
| 547,550 | 10/1895 | Hopkins | 70/56 |
| 1,291,993 | 1/1919 | Matthews | 70/55 |
| 3,718,014 | 2/1973 | Delgadillo | 70/417 |
| 3,976,318 | 8/1976 | Krus | 292/346 |
| 4,300,373 | 11/1981 | Camos et al. | 70/164 |
| 4,655,487 | 4/1987 | Korn et al. | 70/56 |
| 4,760,720 | 8/1988 | Grille | 70/54 |
| 4,781,043 | 11/1988 | Loeffler | 70/54 |
| 4,895,007 | 1/1990 | Eberly | 70/54 |
| 4,898,008 | 2/1990 | Eberly | 70/56 |
| 4,911,486 | 3/1990 | Anderson | 70/54 |
| 5,118,149 | 6/1992 | Emmons | 70/56 |
| 5,219,384 | 6/1993 | Elsfelder et al. | 70/56 |
| 5,307,653 | 5/1994 | Davis | 70/56 |
| 5,321,961 | 6/1994 | Barberi | 70/56 |
| 5,426,959 | 6/1995 | Kies | 70/56 |
| 5,477,710 | 12/1995 | Stefanutti | 70/56 |

*Primary Examiner*—Darnell M. Boucher
*Attorney, Agent, or Firm*—Henderson & Sturm

[57] ABSTRACT

A lock guard (10) for use with a padlock (200) and a conventional tractor trailer door latch system (100). The lock guard (10) comprises a main housing unit (11) dimensioned to cover the door latch system (100) and including an exterior auxiliary housing unit (13) provided with a cut-out (61) dimensioned to receive a padlock (200) and an interior center piece unit (13) having an aperture (42) dimensioned to receive a portion of the padlock for captively engaging portions of the trailer door latch system.

7 Claims, 2 Drawing Sheets

LOCK GUARD FOR A TRACTOR TRAILER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of lock guards in general, and in particular to a lock guard for the handle and lock on a tractor trailer to provide added safety to trailer doors by covering the padlock and latch mechanism.

2. Description of Related Art

As can be seen by reference to the following U.S. Pat. Nos. 3,976,318; 5,321,961; 5,426,959; and 5,447,710 the prior art is replete with myriad and diverse specialized lock guards.

While all of the aforementioned prior art constructions are more than adequate for the basic purpose and function for which they have been specifically designed, none of these patented devices have been specifically designed to provide a lock guard for the handle and lock on a tractor-trailer door.

The Krus reference, U.S. Pat. No. 3,976,318, discloses a burglar-proof cover with a hole in the center for key insertion, the cover to fit over a door lock and be secured to a door. A plate member is mounted to the doorjamb and prevents insertion of a tool between the cover and the jamb.

The Barberi reference, U.S. Pat. No. 5,321,961, discloses a security closure to cover a coin return slot and coin box of a vending machine. Access is provided to the coin insert and the coin return slots.

The Kies reference, U.S. Pat. No. 5,426,959, discloses a guard for enclosing the shackle of a padlock to prevent the shackle from being severed by bolt cutters.

The Stefanutti reference, U.S. Pat. No. 5,477,710, discloses a device for protecting a padlock that substantially covers the padlock.

As a consequence of the foregoing situation, there has existed a longstanding need among owners of tractor-trailers for a new type of lock guard which is specifically designed to cover the handle and lock on a tractor trailer door in a simple, straightforward, and effective manner to prevent unauthorized access to the locking mechanism and the provision of such a construction is a stated objected of the present invention.

BRIEF SUMMARY OF THE INVENTION

Briefly stated, the lock guard for tractor trailers that forms the basis of the present invention comprises a generally enlarged rectangular main housing unit provided with an interior center piece unit and an auxiliary housing unit which projects outwardly from one side of the main housing unit proximate the juncture of the center piece unit with the main housing unit.

As will be explained in greater detail further on in the specification, the main housing unit, the auxiliary housing unit and the center piece unit are all provided with apertures and/or recesses which are dimensioned to accommodate various portions of the tractor-trailer handle and lock so that the lock and selected portions of the handle are covered and the access to the lock is restricted by the presence of the lock guard.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
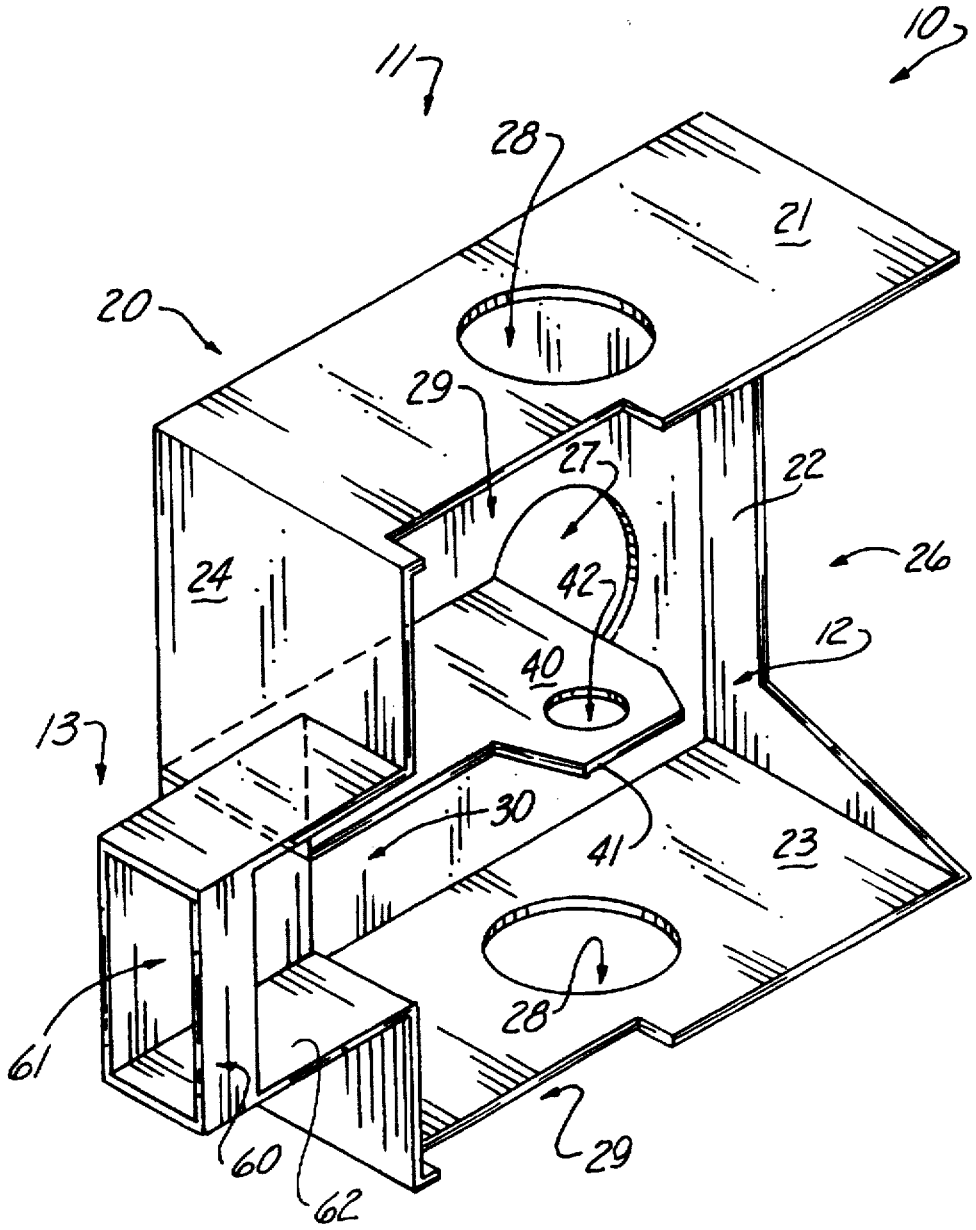
FIG. 1 is a rear perspective view of the lock guard for tractor trailers that forms the basis of the present invention.

As can be seen by reference to the drawings, and in particularly to FIG. 1, the lock guard for tractor trailers that forms the basis of the present invention is designated generally by the reference number (10). The lock guard (10) comprises in general, a main housing unit (11), an interior center piece unit (12), and an auxiliary housing unit (13). These units will now be described in seriatim fashion.

Figure 2:
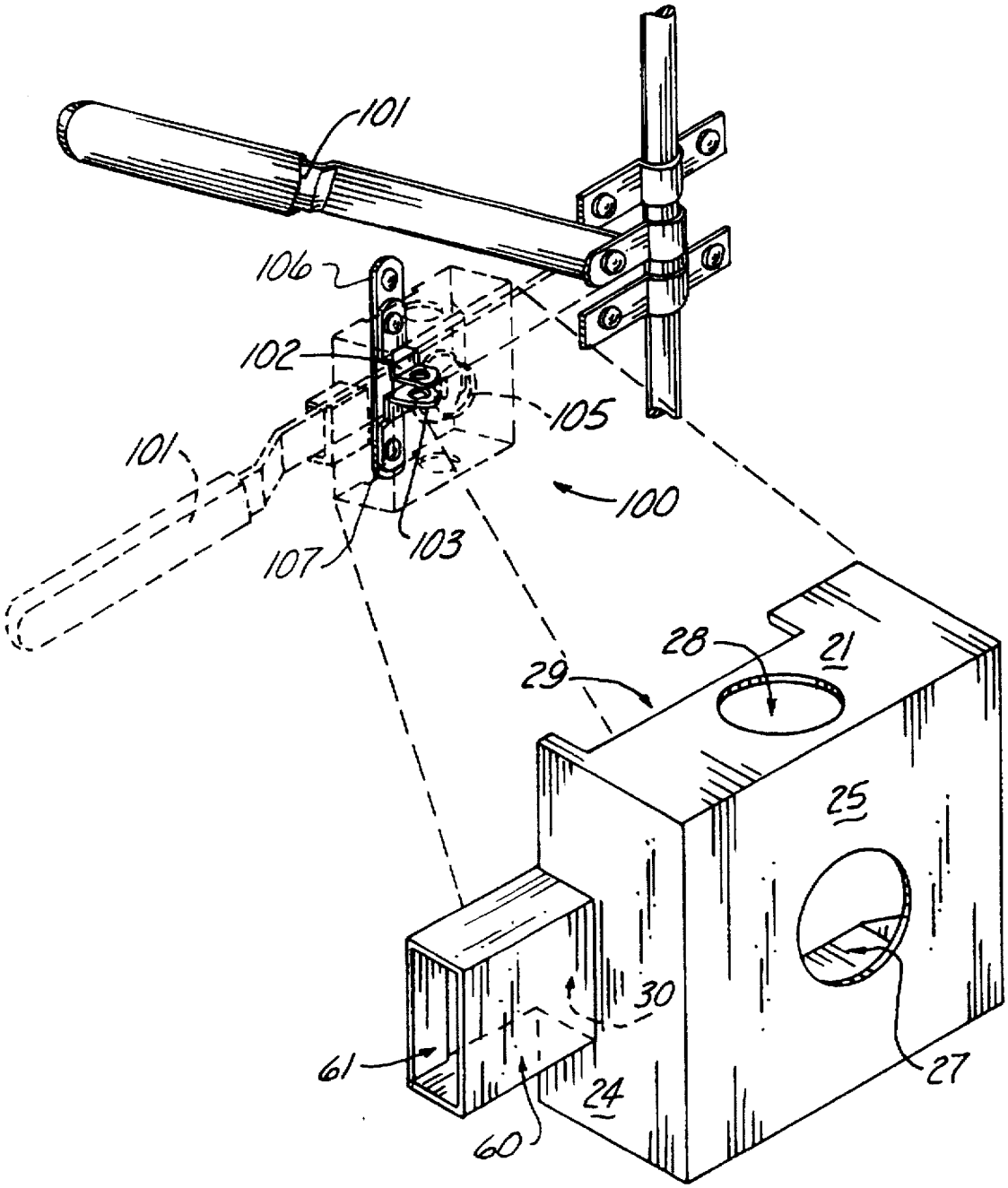
FIG. 2 is a front perspective view of the lock guard.

As can best be seen by reference to FIGS. 1 and 2, the main housing unit (11) comprises an enlarged generally rectangular open ended housing member (20) having a plurality of side panels (21), (22), (23), and (24), a face panel (25), wherein the side panel (22) of the housing member (20) is provided with an enlarged trapezoidal opening (26).

In addition, the face panel (25) of the housing member (20) is provided with an enlarged central aperture (27) and the top (21) and bottom (23) side panels are likewise provided with both aligned central apertures (28) and elongated generally rectangular recesses (29). The left side panel (24) of the housing member (20) is provided with a generally rectangular opening (30) which is in open communication with the interior of the housing member (20). The purpose and function of the aforementioned apertures, recesses, and opening will be explained in greater detail further on in the specification.

As can best be seen by reference to FIG. 1, the center piece unit (12) comprises a generally L-shaped center piece member (40) rigidly affixed to both the interior of the face panel (25) and the side panel (24). In addition, the foot portion (41) of the center piece member (40) is further provided with a discrete aperture (42) whose purpose and function will likewise be described in greater detail further on in the specification.

Still referring to FIG. 1, it can be seen that the auxiliary housing unit (13) comprises a generally rectangular extension member (60) having a rectangular opening (61) formed on one end which is in open communication with the interior of the main housing member (20) via the rectangular opening (30) formed in side panel (24) of the housing member 20). In addition, another opening (62) is formed on the bottom of the extension member.

As has been mentioned previously, the lock guard (10) that forms the basis of the present invention is designed to form a protective shield that fits over the existing trailer latch system of a tractor trailer to provide added safety to trailer doors.

In use, the user would slide the housing extension member (60) over the handle (101) of a trailer latch (100), wherein the handle would pass through the rectangular openings (61), (30), and the trapezoidal opening (26). The user would then close the handle (101) in a normal manner and place the foot portion (41) of the center piece member (40) between the top (102) and bottom (103) hasps in front of the handle (101). Then the user would insert a padlock (105) through the trapezoidal opening (26) in the side panel (22) of the housing in the member (20) and engage the padlock (105) through the hasps (102), (103) and the aperture (42) in the foot (41) of the center piece member (40), thereby securing the lock guard (10) over the handle (101) and hasps (102), (103) and locking the lock guard (10) in place.

In addition, the rectangular recesses (29) in the top (21) and bottom (23) side panels are dimensioned to permit clearance for the vertical locking bars (106), (107) located on the tractor trailer truck. The vertically aligned apertures (28) and the front aperture (27) are provided to permit the user to manipulate the padlock (105) into position.

In this manner, the lock guard (10) of this invention greatly reduces the probability of theft of tractor trailers by covering the padlock and latch mechanism thus increasing the difficulty of breaking or otherwise removing the lock.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A lock guard for use with a padlock and a conventional tractor trailer door latch system including a door handle, a pair of vertical locking bars and a pair of hasps wherein the lock guard comprises:

an enlarged generally rectangular housing member including a pair of side panels, a top panel, a bottom panel, and a face panel wherein two of the side panels are provided with aligned openings; each top and bottom panel is provided with an enlarged aperture and a rectangular recess, said enlarged apertures and said rectangular recesses being, respectively, aligned with one another;

an auxiliary housing unit operatively associated with said one of the side panels and further provided with a rectangular cut-out aligned with both of said aligned openings in the side panels; and a center piece member extending from at least one of said panels within said housing and aligned generally parallel to said top and bottom panels; wherein, said center piece member is further provided with a discrete aperture which is aligned with said enlarged apertures in the housing member.

2. The lock guard as in claim 1 wherein said center piece member has a generally L-shaped configuration and the discrete aperture is disposed in the foot portion of the center piece member.

3. The lock guard as in claim 1 wherein said face panel is also provided with an enlarged aperture.

4. The lock guard as in claim 1 wherein said rectangular recesses are adapted to receive a portion of said vertical locking bars.

5. The lock guard as in claim 1 wherein at least one of said aligned apertures is adapted to receive a padlock.

6. The lock guard as in claim 1 wherein said discrete aperture is adapted to receive a portion of the padlock.

7. The lock guard as in claim 3 wherein the aligned enlarged apertures and the aperture in the face panel are adapted to receive a user's fingers to manipulate a padlock within the housing member.

* * * * *